US010519790B2

(12) United States Patent
Hafner et al.

(10) Patent No.: US 10,519,790 B2
(45) Date of Patent: Dec. 31, 2019

(54) TURBINE SHROUD ASSEMBLY

(71) Applicant: GENERAL ELECTRIC COMPANY, Schenectady, NY (US)

(72) Inventors: Matthew Troy Hafner, Honea Path, SC (US); John McConnell Delvaux, Fountain Inn, SC (US); Glenn Curtis Taxacher, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 154 days.

(21) Appl. No.: 15/623,696

(22) Filed: Jun. 15, 2017

(65) Prior Publication Data

US 2018/0363483 A1 Dec. 20, 2018

(51) Int. Cl.

| | |
|---|---|
| ***F01D 11/08*** | (2006.01) |
| ***F01D 9/04*** | (2006.01) |
| ***F01D 25/24*** | (2006.01) |
| *F01D 11/02* | (2006.01) |

(Continued)

(52) U.S. Cl.

CPC ..... *F01D 9/04* (2013.01); *F01D 11/08* (2013.01); *F01D 25/243* (2013.01); *F01D 11/005* (2013.01); *F01D 11/025* (2013.01); *F01D 11/22* (2013.01); *F01D 25/246* (2013.01); *F05D 2230/237* (2013.01); *F05D 2230/60* (2013.01); *F05D 2240/11* (2013.01); *F05D 2260/941* (2013.01); *F05D 2300/171* (2013.01);

(Continued)

(58) Field of Classification Search

CPC ..... F01D 11/08; F01D 11/005; F01D 11/16; F01D 11/18

See application file for complete search history.

(56) References Cited

U.S. PATENT DOCUMENTS 4,907,411 A * 3/1990 Krueger ..... F23R 3/007 60/753
5,423,659 A * 6/1995 Thompson ..... F01D 25/246 415/139

(Continued)

OTHER PUBLICATIONS

EPO International Search Report; dated Dec. 6, 2018.

*Primary Examiner* — Carlos A Rivera
*Assistant Examiner* — Behnoush Haghighian
(74) *Attorney, Agent, or Firm* — McNees Wallace & Nurick LLC

(57) ABSTRACT

A turbine component includes an outer shroud arranged within a turbine and further including opposed extending portions. The component further provides an inner shroud shielding the outer shroud from a gas path within the turbine during operation of the turbine and including opposed arcuate portions extending around and in direct contact with a corresponding extending portion of the outer shroud for supporting the inner shroud from the outer shroud. The component further provides a load path forming region at least partially extending between facing surfaces of each arcuate portion and corresponding extending portion. During operation of the turbine, load path forming regions extend into direct contact between at least a portion of the facing surfaces of each arcuate portion and corresponding extending portion, resulting in formation of a loading arrangement having generally evenly distributed radial load forces at the load path forming regions.

18 Claims, 3 Drawing Sheets

(51) Int. Cl.
*F01D 11/22* (2006.01)
*F01D 11/00* (2006.01)

(52) U.S. Cl.
CPC .. *F05D 2300/175* (2013.01); *F05D 2300/177* (2013.01); *F05D 2300/6033* (2013.01)

(56) References Cited

U.S. PATENT DOCUMENTS 5,603,510 A * 2/1997 Sanders ..... F01D 11/025 277/413
6,131,910 A * 10/2000 Bagepalli ..... F01D 5/225 277/355
6,315,519 B1 * 11/2001 Bagepalli ..... F01D 11/08 415/135
6,572,115 B1 * 6/2003 Sarshar ..... F16J 15/3288 277/412
6,758,653 B2 7/2004 Morrison
6,854,736 B2 * 2/2005 Paprotna ..... F01D 11/001 277/413
7,229,246 B2 * 6/2007 Ghasripoor ..... F04D 29/126 277/413
7,909,335 B2 * 3/2011 Turnquist ..... F16J 15/441 277/355
8,540,479 B2 * 9/2013 Awtar ..... F01D 11/025 415/113
9,945,243 B2 * 4/2018 O'Leary ..... F01D 11/12
10,054,232 B2 * 8/2018 Seaton ..... F16J 15/443
10,060,294 B2 * 8/2018 Lamusga ..... F01D 25/28
10,100,670 B2 * 10/2018 Leslie ..... F01D 25/145
2003/0133790 A1 7/2003 Darkins, Jr. et al.
2010/0078893 A1 * 4/2010 Turnquist ..... F01D 11/025 277/303
2011/0305578 A1 * 12/2011 Smarsly ..... B23K 20/1205 416/223 R
2013/0202433 A1 * 8/2013 Hafner ..... F01D 5/3015 415/230
2015/0345308 A1 * 12/2015 Roberts, Jr. ..... F01D 11/001 416/212 A
2016/0201910 A1 * 7/2016 Chang ..... F01D 11/08 60/753
2016/0348523 A1 * 12/2016 Thomas ..... F01D 11/005
2017/0260869 A1 * 9/2017 Vetters ..... F01D 11/08

* cited by examiner

TURBINE SHROUD ASSEMBLY

FIELD OF THE INVENTION

The present invention is directed to turbine shroud assemblies. More particularly, the present invention is directed to turbine shroud assemblies having generally evenly distributed load forces between inner and outer shrouds during turbine operation.

BACKGROUND OF THE INVENTION

Hot gas path components of gas turbines, which include metal and ceramic matrix composite ("CMC") components that are positioned adjacent to each other, are subjected to elevated temperatures and harsh environments during operation. For example, turbine shrouds include a hot gas path-facing sub-component which is not fully secured to, but in contact with, a non-hot gas path-facing sub-component. These sub-components are subject to heat distortion because of high thermal gradients in the turbine shrouds. Such heat distortion places these sub-components under significant mechanical stresses that may be unevenly distributed.

BRIEF DESCRIPTION OF THE INVENTION

In an exemplary embodiment, a turbine component includes an outer shroud arranged within a turbine and further including opposed extending portions. The component further provides an inner shroud shielding the outer shroud from a gas path within the turbine during operation of the turbine and including opposed arcuate portions extending around and in direct contact with a corresponding extending portion of the outer shroud for supporting the inner shroud from the outer shroud. The component further provides a load path forming region at least partially extending between facing surfaces of each arcuate portion and corresponding extending portion. During operation of the turbine, load path forming regions extend into direct contact between at least a portion of the facing surfaces of each arcuate portion and corresponding extending portion, resulting in formation of a loading arrangement having generally evenly distributed radial load forces at the load path forming regions.

In another exemplary embodiment, a turbine shroud assembly includes an outer shroud arranged within the turbine and including an upstream edge and an opposed downstream edge each extending along a circumferential length. The turbine shroud assembly further provides an inner shroud including an upstream portion and an opposed downstream portion each extending along a circumferential length and each having an arcuate shape defining an upstream slot and a downstream slot receiving and in direct contact with respectively the upstream edge and the downstream edge of the outer shroud for supporting the inner shroud from the outer shroud and for shielding the outer shroud from a gas path within the turbine. The turbine shroud assembly further provides a load path region at least partially extending between facing surfaces of the upstream slot and upstream edge, and the downstream slot and downstream edge. During operation of the turbine, load path forming regions extend into direct contact between at least a portion of the facing surfaces of each of the upstream slot and upstream edge, and the downstream slot and downstream edge, resulting in formation of a loading arrangement having generally evenly distributed radial load forces at the load path forming regions.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary turbine components, such as inner shrouds and outer shrouds and turbine shroud assemblies. Embodiments of the present disclosure, in comparison to articles not utilizing one or more features disclosed herein, have generally evenly distributed radial load forces between opposed ends (i.e., forward and aft) of inner and outer shrouds during operation of the turbine, resulting in reduced cost, increased component life, decreased maintenance requirements, or combinations thereof.

Figure 1:
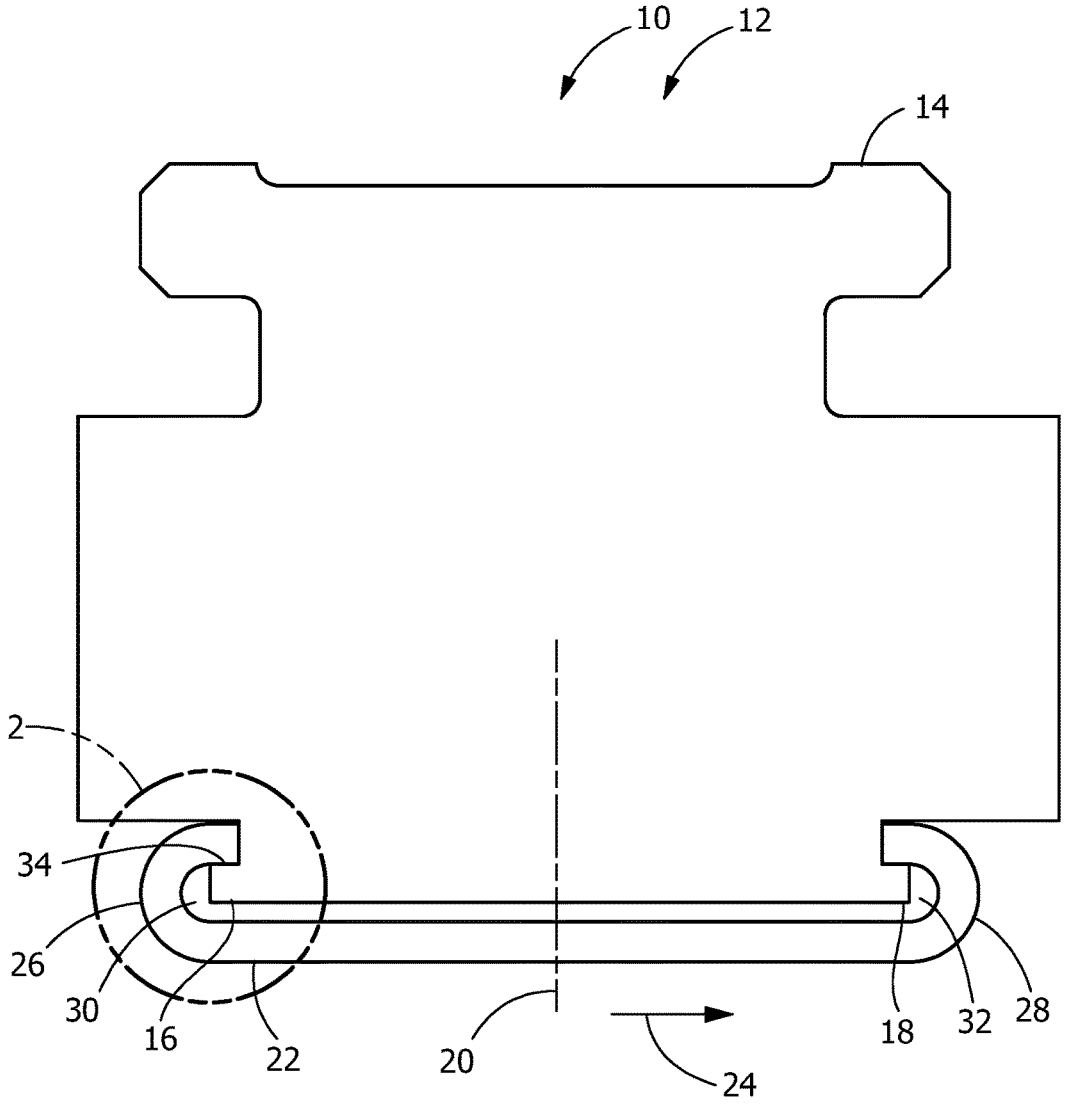
FIG. 1 is an elevation view of an exemplary shroud assembly, according to an embodiment of the present disclosure.

Referring to FIG. 1, a gas turbine 10 includes a turbine assembly or shroud assembly 12 having an outer shroud 14 arranged within the gas turbine. Outer shroud 14 includes opposed extending portions 16, 18 or an upstream edge or portion 16 and an opposed downstream edge or portion 18 extending along a circumferential length. An inner shroud 22 extends along a circumferential length adjacent outer shroud 14 and shields the outer shroud from a hot gas 24 flowing along a hot gas path within gas turbine 10 during operation of the gas turbine. Inner shroud 22 comprises an arcuate portion or arcuate upstream portion 26 defining an upstream slot 30 for receiving in direct contact upstream edge or portion 16 of outer shroud 14, and an arcuate portion or arcuate downstream portion 28 defining a downstream slot 32 for receiving in direct contact downstream edge or portion 18 of outer shroud 14. In one embodiment, a single outer shroud 14 may receive multiple inner shrouds 22. Load path forming regions 34 are positioned between inner shroud 22 and outer shroud 14 and extends between arcuate portions 26, 28, as will be discussed in further detail below.

In one embodiment, such as shown in FIG. 1, upstream edge or portion 16 of outer shroud 14 and arcuate upstream portion 26 are mirror images of downstream edge or portion 18 of outer shroud 14 and arcuate downstream portion 28 about a center plane 20. For the sake of brevity, only one will be described in detail, however, it should be appreciated that this detailed description applies to both upstream and downstream shroud portions.

Figure 2:
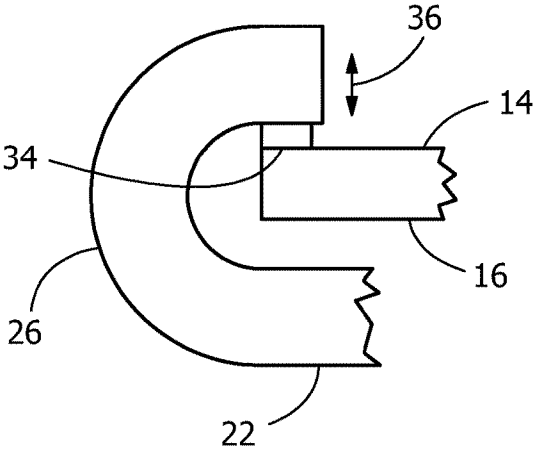
FIG. 2 is an enlarged, partial elevation view of the shroud assembly taken from region 2 of FIG. 1, according to the present disclosure.

FIG. 2, which is an enlarged, partial elevation view of the shroud assembly taken from region 2 of FIG. 1, shows a load path forming region 34 extending between facing surfaces of upstream edge or portion 16 of outer shroud 14 (FIG. 1) and arcuate upstream portion 26. In one embodiment, load path forming region 34 extends in direct contact between facing surfaces of upstream edge or portion 16 of outer shroud 14 and arcuate upstream portion 26. In one embodiment, at least a portion of load path forming region 34 extends in direct contact between facing surfaces of upstream edge or portion 16 of outer shroud 14 and arcuate upstream portion 26. In one embodiment, none of load path forming region 34 may extend in direct contact between facing surfaces of upstream edge or portion 16 of outer shroud 14 and arcuate upstream portion 26. A loading arrangement 36 is formed during operation of the turbine, resulting in generally evenly distributed load forces at the load path forming regions 34. That is, as a result of using load path forming regions 34, effects of thermal chord to the shroud assembly may be minimized during operation of the turbine, which minimizes stress in the CMC inner shroud 22 (FIG. 1). Thermal chord is a difference between the circumferential pattern (i.e., flattening) along at least one of the upstream edge or portion 16 of outer shroud 14 as compared to the circumferential pattern along the upstream edge or portion 26 of inner shroud 22, occurring as a result of heating the inner and outer shrouds 22, 14 during operation of the turbine, which inner and outer shrouds 22, 14 have different coefficients of thermal expansion, although outer shroud 14 is subjected to lower temperatures than inner shroud 22. At some operating conditions, inner shroud 22 chords or flattens more than outer shroud 14 due to the inner shroud's higher temperature compared to the temperature of the outer shroud 22, as a result of inner shroud 22 being closer to the hot gas path. In one embodiment, as a result of operation of the turbine, load path forming regions 34 extend into direct contact between at least a portion of the facing surfaces of upstream edge or portion 16 of outer shroud 14 and arcuate upstream portion 26 of inner shroud 22. By forming loading arrangement 36 during operation of the turbine, with generally evenly distributing load forces resulting at the load path forming regions 34 at predetermined positions to minimize stress in inner shroud 22, material thickness of at least the inner shroud may be reduced, resulting in cost savings.

For purposes herein, the term "load path forming" in the context of a "load path forming region" and the like means that added material is provided between predetermined portions of corresponding surfaces of components, such as between corresponding surfaces of inner and outer shrouds. In response to a change of conditions of the components, such as in response to an increase in temperature of the components, in which the relative distances between at least a portion of the corresponding component facing surfaces change (i.e., are reduced), the added material extends into direct contact with at least a portion of the corresponding component facing surfaces. The direct contact of the added material and corresponding component facing surfaces results in formation of a loading arrangement having generally evenly distributed forces at the portion of the corresponding component facing surfaces in contact with the added material. These evenly distributed forces represent at least a considerable majority, if not essentially, the entirety of forces generated along the predetermined portions of the component surfaces.

For purposes herein, "added material" includes material secured to at least one of the corresponding component surfaces, as well as material inserted between corresponding component surfaces, such as shims.

Figure 4:
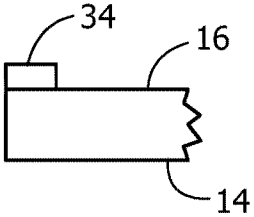
FIG. 4 is the enlarged, partial elevation view of the outer shroud of FIG. 2, according to the present disclosure.
Figure 3:
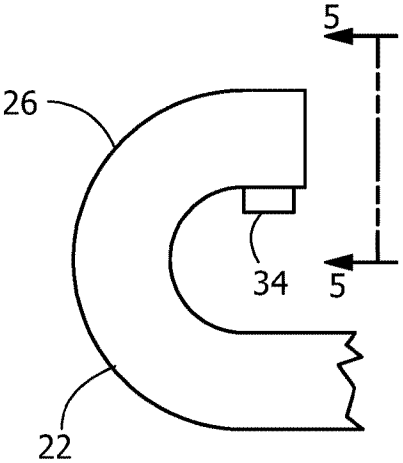
FIG. 3 is the enlarged, partial elevation view of the inner shroud of FIG. 2, according to the present disclosure.
Figure 8:
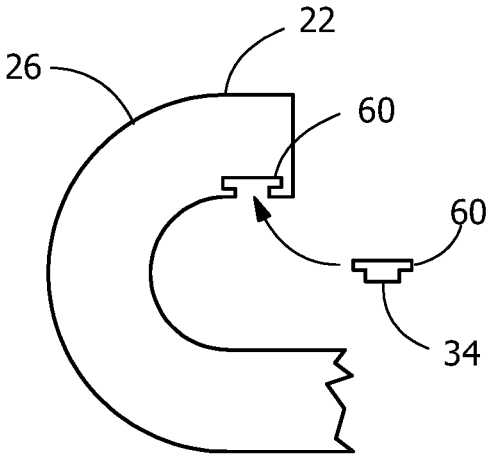
FIG. 8 is an elevation view of exemplary mechanical joining features between an inner shroud and a load path forming region, according to the present disclosure.

FIG. 3, which essentially is FIG. 2 minus outer shroud 14, shows load path forming region 34 secured to or affixed to upstream portion 26 of inner shroud 22. FIG. 4, which is essentially FIG. 2 minus inner shroud 22, shows load path forming region 34 secured to upstream edge or portion 16 of outer shroud 14. In one embodiment, load path forming regions 34 are affixed by welding, brazing, bonding, mechanical connection—such as a T-slot 60 (FIG. 8), entrapped—depression that holds load path forming region 34 during assembly and is then trapped in place by the inner and outer shrouds 22, 14, or a combination thereof.

Figure 5:
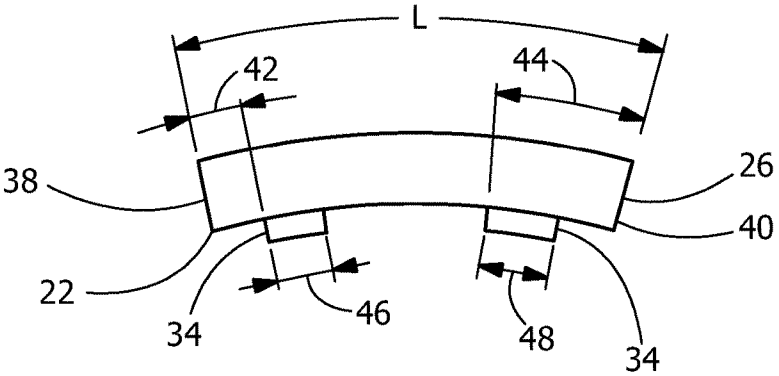
FIG. 5 is an end view of the inner shroud taken along line 5-5 of FIG. 3, according to the present disclosure.

FIG. 5, which is an end view of inner shroud 22 taken along line 5-5 of FIG. 3, shows an exemplary arrangement of an upstream portion 26 having a length L and opposed ends 38, 40. As shown, load path forming regions 34 may be positioned between a distance 42 from end 38, which does not include a length 46 of the load path forming region 34, and a distance 44 from end 40, which does include a length 48 of the load path forming region 34. In one embodiment, for an exemplary upstream portion 26 having a length of 6 inches, distance 42 may be 0.6 inch and distance 44 may be 2.4 inches. Stated another way, load path forming region 34 is positionable between 10 percent and 40 percent from each end of a length of corresponding inner and outer shrouds 14, 22 (FIG. 1). In one embodiment, at least one load path forming region may be continuous (i.e., unitary or one piece construction). In one embodiment, at least one load path forming region may be discontinuous, or having multiple piece construction. As further shown in FIG. 5, load path forming regions 34 have corresponding lengths 46, 48 that are between 5 percent and 20 percent of a length of corresponding inner and outer shrouds 14, 22. In one embodiment, in which opposed ends of inner and outer shrouds 14, 22 are each depicted with a pair of load path forming regions 34 as shown in FIG. 5, would result in a four-point loading arrangement. In another embodiment, the number of load path forming regions 34 for at least one of upstream edge or portion 16 of outer shroud 14 and arcuate upstream portion 26, and portion 18 of outer shroud 14 and arcuate downstream portion 28 may be different than two (i.e., a pair), resulting in the formation of a loading arrangement different than a four-point loading arrangement. In one embodiment, the number of load path forming regions 34 for upstream edge or portion 16 of outer shroud 14 and arcuate upstream portion 26, and portion 18 of outer shroud 14 and arcuate downstream portion 28 may be different from each other. In one embodiment, the positions of load path forming regions 34 for upstream edge or portion 16 of outer shroud 14 and arcuate upstream portion 26, and portion 18 of outer shroud 14 and arcuate downstream portion 28 may be different from each other. In one embodiment, the sizes (including height, length and width) of load path forming regions 34 for upstream edge or portion 16 of outer shroud 14 and arcuate upstream portion 26, and portion 18 of outer shroud 14 and arcuate downstream portion 28 may be different from each other. In one embodiment, any combination of differences or non-differences between size, position, height (FIG. 4); inclusion or non-inclusion of a crown 52 (FIG. 6) and number of load path forming regions 34 for upstream edge or portion 16 of outer shroud 14 and arcuate upstream portion 26, and portion 18 of outer shroud 14 and arcuate downstream portion 28 may be used, depending on design considerations or for other reasons.

Figure 6:
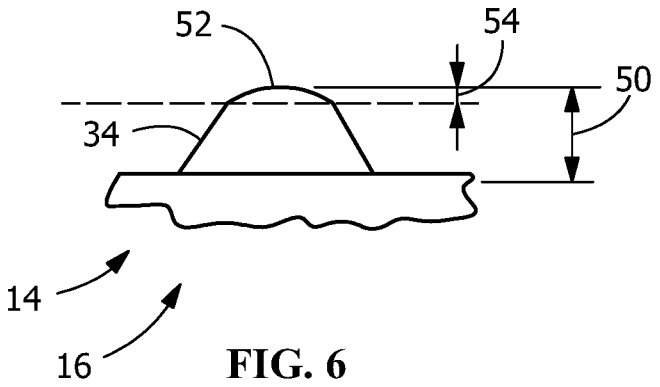
FIG. 6 is an enlarged, partial elevation view of an exemplary load path forming region of the outer shroud of FIG. 4, according to the present disclosure.

FIG. 6, which is an enlarged, partial elevation view of an exemplary load path forming region 34 of the outer shroud 14 of FIG. 4, has an overall height 50 of between 0.01 inch and 0.1 inch. As further shown in FIG. 6, load path forming region 34 includes a crown 52 having a height 54 between zero and 0.01 inch. In one embodiment, the height of at least one load path forming region may be the same. In one embodiment, the height of at least one load path forming region may be different. In one embodiment, at least one load path forming region may include a crown. In one embodiment, at least one load path forming region may include a crown having a different height than another crown.

Figure 7:
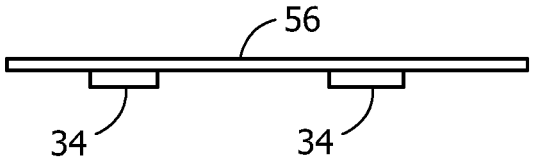
FIG. 7 is an elevation view of an exemplary shim with load path forming regions, according to the present disclosure.

FIG. 7 shows an elevation view of an exemplary shim 56 with two load path forming regions 34. In one embodiment, shim 56 may have a different number of load path forming regions 34 than two. In one embodiment, shim 56 may be selectively removable from between each of upstream edge or portion 16 of outer shroud 14 and arcuate upstream portion 26, and portion 18 of outer shroud 14 and arcuate downstream portion 28. In one embodiment, load path forming regions 34 of shim 56 may extend toward a facing surface of inner shroud 22. In one embodiment, load path forming regions 34 of shim 56 may extend toward a facing surface of outer shroud 14. In one embodiment, the shim may be of unitary (one piece) construction. In one embodiment, the shim may be formed having multiple piece construction.

The inner shroud 22 may include any suitable material composition, including, but not limited to, CMC material such as, but not limited to, CMCs, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides (C/Si3N4), or silicon-carbide-fiber-reinforced silicon nitrides (SiC/Si3N4), or combinations thereof.

The outer shroud 14 may include any suitable material composition, including, but not limited to, iron alloys, steels, stainless steels, carbon steels, nickel alloys, superalloys, nickel-based superalloys, INCONEL 738, cobalt-based superalloys, or combinations thereof.

Load path forming region 34 may include any suitable material composition, including, but not limited to, CMC material such as, but not limited to, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides (C/Si3N4), or silicon-carbide-fiber-reinforced silicon nitrides (SiC/Si3N4), or iron alloys, steels, stainless steels, carbon steels, nickel alloys, or CrMo steels, or superalloy material, such as, but not limited to, nickel-based superalloys, cobalt-based superalloys, CRUCIBLE 422, HAYNES 188, INCONEL 718, INCONEL 738, INCONEL X-750, cobalt-based superalloys, or cobalt L-605, or combinations thereof.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "CrMo steel" refers to a steel alloyed with at least chromium and molybdenum. In one embodiment, the CrMo steels are 41xx series steels, such as 4140, as specified by the Society of Automotive Engineers.

As used herein, "CRUCIBLE 422" refers to an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron. CRUCIBLE 422 is available from Crucible Industries LLC, 575 State Fair Boulevard, Solvay, N.Y., 13209.

As used herein, "HAYNES 188" refers to an alloy including a composition, by weight, of about 22% chromium, about 22% nickel, about 0.1% carbon, about 3% iron, about 1.25% manganese, about 0.35% silicon, about 14% tungsten, about 0.03% lanthanum, and a balance of cobalt.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine component comprising:

an outer shroud arranged within a turbine and further comprising opposed extending portions;

an inner shroud shielding the outer shroud from a gas path within the turbine during operation of the turbine and comprising opposed arcuate portions extending around and in direct contact with a corresponding extending portion of the outer shroud for supporting the inner shroud from the outer shroud;

wherein a pair of load path forming regions at least partially extends between facing surfaces of one surface of each arcuate portion and a corresponding extending portion;

wherein during operation of the turbine, the pair of load path forming regions extend into direct contact between at least a portion of the facing surfaces of the one surface of each arcuate portion and corresponding extending portion, resulting in formation of a four-point loading arrangement between the at least a portion of the facing surfaces of the one surface of each arcuate portion and corresponding extending portion having evenly distributed radial load forces at the load path forming regions; and wherein during non-operation of the turbine, the load path forming regions are in non-contact.

2. The turbine component of claim 1, wherein at least one load path forming region of the pair of load path forming regions is selectively removable from between each arcuate portion and corresponding extending portion.

3. The turbine component of claim 2, wherein at least one load path forming region of the pair of load path forming regions is a shim.

4. The turbine component of claim 1, wherein at least one load path forming region of the pair of load path forming regions is affixed to the one surface of each arcuate portion and corresponding extending portion by welding, brazing, bonding, mechanical connection, or a combination thereof.

5. The turbine component of claim 1, wherein the pair of load path forming regions is positionable between 10 percent and 40 percent from each end of a length of each arcuate portion and corresponding extending portion.

6. The turbine component of claim 1, wherein the pair of load path forming regions is between 5 percent and 20 percent of a length of at least one of each arcuate portion and corresponding extending portion.

7. The turbine component of claim 1, wherein at least one load path forming region of the pair of load path forming regions has a crown having a height greater than zero.

8. The turbine component of claim 7, wherein the crown height is between greater than zero and 0.01 inch.

9. The turbine component of claim 1, wherein at least one load path forming region of the pair of load path forming regions has a height between 0.01 inch and 0.1 inch.

10. The turbine component of claim 1, wherein the load path forming region has a composition formed from the group consisting of aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides (C/Si3N4), silicon-carbide-fiber-reinforced silicon nitrides (SiC/Si3N4), iron alloys, steels, stainless steels, carbon steels, nickel alloys, CrMo steels, nickel-based superalloys, cobalt-based superalloys, an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron, an alloy including a composition, by weight, of about 22% chromium, about 22% nickel, about 0.1% carbon, about 3% iron, about 1.25% manganese, about 0.35% silicon, about 14% tungsten, about 0.03% lanthanum, and a balance of cobalt, an alloy including a composition, by weight, of about 19% chromium, about 18.5% iron, about 3% molybdenum, about 3.6% niobium and tantalum, and a balance of nickel, an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel, an alloy including a composition, by weight, of about 15.5% chromium, about 7% iron, about 2.5% titanium, about 0.7% aluminum, and about 0.5% niobium and tantalum, and a balance of nickel, cobalt-based superalloys, an alloy including a composition, by weight, of about 20% chromium, about 10% nickel, about 15% tungsten, about 0.1% carbon, about 1.5% manganese, and a balance of cobalt, or combinations thereof.

11. A turbine shroud assembly comprising:

an outer shroud arranged within the turbine and comprising an upstream edge and an opposed downstream edge each extending along a circumferential length;

an inner shroud comprising an upstream portion and an opposed downstream portion each extending along a circumferential length and each having an arcuate shape defining an upstream slot and a downstream slot receiving and in direct contact with respectively the upstream edge and the downstream edge of the outer shroud for supporting the inner shroud from the outer shroud and for shielding the outer shroud from a gas path within the turbine;

wherein a pair of load path forming regions at least partially extends between facing surfaces of the upstream slot and the upstream edge, and the downstream slot and the downstream edge;

wherein during operation of the turbine, the pair of load path forming regions extend into direct contact between at least a portion of one surface of the facing surfaces of each of the upstream slot and the upstream edge, and the downstream slot and the downstream edge, resulting in formation of a four point loading arrangement between the at least a portion of the one surface of the facing surfaces of each of the upstream slot and the upstream edge, and the downstream slot and the downstream edge having evenly distributed radial load forces at the load path forming regions; and wherein during non-operation of the turbine, the load path forming regions are in non-contact.

12. The turbine shroud assembly of claim 11, wherein the pair of load path forming regions is selectively removable from between each arcuate-shaped portion and corresponding upstream edge and downstream edge.

13. The turbine shroud assembly of claim 12, wherein the pair of load path forming regions is a shim.

14. The turbine shroud assembly of claim 11, wherein the pair of load path forming regions is affixed to the one surface of each arcuate-shaped portion and corresponding extending portion by welding, brazing, bonding, mechanical connection, or a combination thereof.

15. The turbine shroud assembly of claim 12, wherein the pair of load path forming regions is positionable between 10 percent and 40 percent from an end of a length of at least one of each arcuate-shaped portion and corresponding upstream edge and downstream edge.

16. The turbine shroud assembly of claim 12, wherein the pair of load path forming regions is between 5 percent and 20 percent of a length of at least one of each arcuate portion and corresponding upstream portion and downstream edge.

17. The turbine shroud assembly of claim 11, wherein at least one load path forming region of the pair of path forming regions has a crown having a height between greater than zero and 0.01 inch.

18. The turbine shroud assembly of claim 12, wherein at least one load path forming region of the pair of path forming regions has a height between 0.01 inch and 0.1 inch.

* * * * *